United States Patent [19]

Wirt

[11] Patent Number: 4,667,768

[45] Date of Patent: May 26, 1987

[54] SOUND ABSORBING PANEL

[75] Inventor: Leslie S. Wirt, Newhall, Calif.

[73] Assignee: Lockheed Corporation, Calabasas, Calif.

[21] Appl. No.: 857,709

[22] Filed: May 1, 1986

[51] Int. Cl.[4] ..... F04B 1/82

[52] U.S. Cl. ..... 181/286; 181/292

[58] Field of Search ..... 181/222, 286, 288, 291, 181/292

[56] References Cited

U.S. PATENT DOCUMENTS

| | | | |
|---|---|---|---|
| 3,734,234 | 5/1973 | Wirt | 181/286 |
| 3,831,710 | 8/1974 | Wirt | 181/286 |
| 4,441,578 | 4/1984 | Rose | 181/222 |
| 4,560,028 | 12/1985 | Perret | 181/286 X |

*Primary Examiner*—Benjamin R. Fuller

*Attorney, Agent, or Firm*—Frederic P. Smith

[57] ABSTRACT

In the present invention an improved sound absorbing panel is provided. The panel comprises an array of wall defining means configured to provide two or more contiguous hollow cells having adjacent open ends and adjacent closed impermeable ends, the open ends defining a sound receiving end of the array, at least one impermeable three dimensional closed surface disposed in at least one of the cells, and a flow resistive permeable facing sheet covering the sound receiving end. Approximately 50 percent of the cells may be filled in a periodic arrangement. The three dimensional closed surface may be a sphere or a cylinder and may be bonded to the closed impermeable ends or to the wall defining means. A drainage notch is provided. The present invention is particularly suitable for sound attenuation in jet engines and other applications having adverse environmental conditions and requiring sound absorptive panels, baffles, duct liners, and duct splitters.

14 Claims, 5 Drawing Figures

FIG. 3
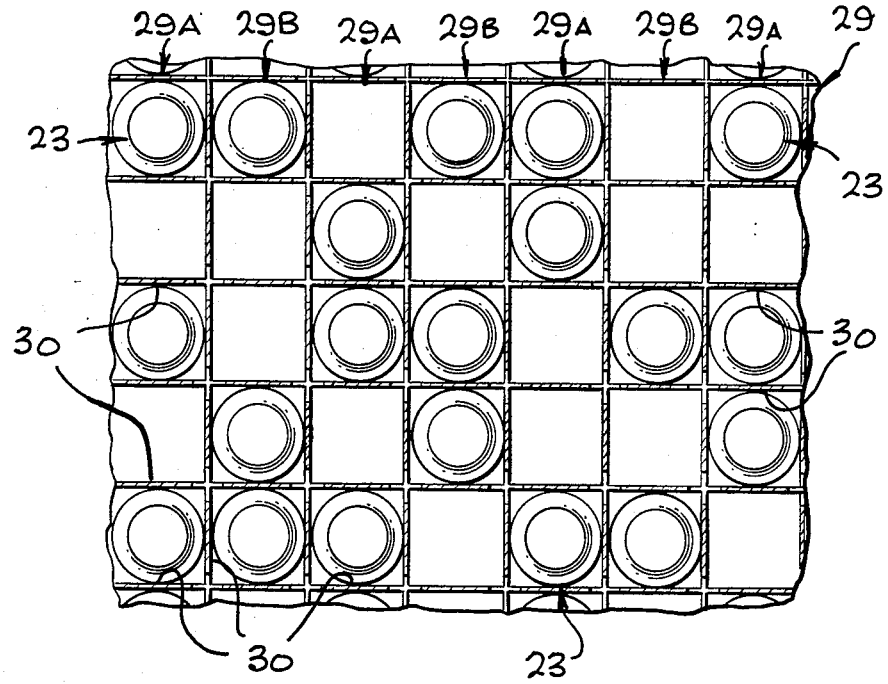
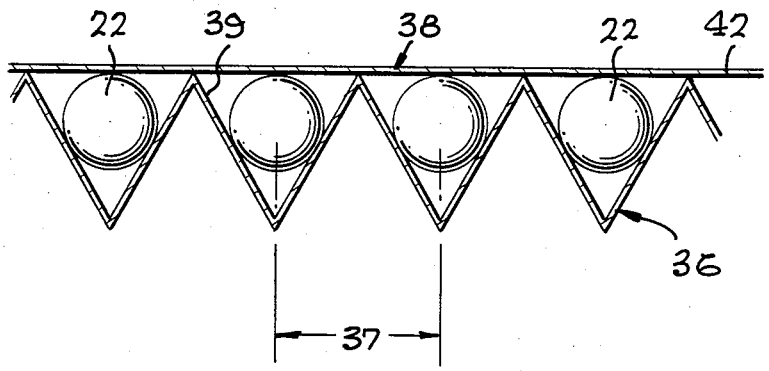
FIG. 5

SOUND ABSORBING PANEL

TECHNICAL FIELD

The invention relates to the field of sound absorbing panels and, in particular, to a laminar sound absorbing panel capable of providing absorption over a wide range of frequencies.

BACKGROUND INFORMATION

Although industrial noise pollution has always existed, it has become more acute through the use of larger and higher speed machinery needed to increase production output. Also, modern jet engines, as is well-known, produce a higher perceived noise level than the reciprocating internal combustion engines which they have generally replaced. To diminish this noise level, the inlet and exhaust ducts of jet engines commonly contain sound absorptive linings of the laminar absorber types.

One of the types of air-borne broad-band prior art sound absorbing panels is a honeycomb panel comprising an impermeable backing sheet, a permeable flow resistive facing cover and a honeycomb core therebetween, wherein the cells of the honeycomb core are configured so that adjacent cell subcompartments within each honeycomb cell have different resonant frequencies. One such honeycomb panel type absorber is disclosed in U.S. Pat. No. 3,831,710 entitled "Sound Absorbing Panel" by Leslie S. Wirt which is incorporated herein by reference and which is assigned to the assignee of the present invention. However, two problems arose in the manufacture of this sound absorbing panel: the geometry of the core required expensive and precise fine tooling; and since, in many applications, such panels were exposed to liquids, means had to be provided to drain the fluids which further complicated the design of the core.

It is therefore an object of the present invention to provide a novel and improved sound absorbing panel.

A further object of the present invention is to provide an improved sound absorbing panel that is easy to manufacture.

Another object of the invention is to provide an improved sound absorbing panel which exhibits broad-band acoustical absorption, and which is suitable for use under extreme environmental conditions and, in particular, exposure to fluids.

DISCLOSURE OF THE INVENTION

In the present invention an improved sound absorbing panel is provided. The panel comprises an array of wall defining means configured to provide two or more contiguous hollow cells having adjacent open ends and adjacent closed impermeable ends, the open ends defining a sound receiving end of the array, at least one impermeable three dimensional closed surface disposed in at least one of the cells and a flow resistive permeable facing sheet covering the sound receiving end. Approximately 50 percent of the cells may be filled in a periodic arrangement. The three dimensional closed surface may be a sphere or a cylinder and may be bonded to the closed impermeable ends or to the wall defining means. A drainage notch is provided.

The novel features which are believed to be characteristic of the invention, both as to its organization and method of operation, together with further objects and advantages thereof, will be better understood from the following description in connection with the accompanying drawings in which the presently preferred embodiments of the invention are illustrated by way of examples. It is to be expressly understood, however, that the drawings are for purposes of illustration and description only and are not intended as a definition of the limits of the invention.

BRIEF DESCRIPTION OF THE DRAWINGS

FIG. 3 is a plan view of a sound absorbing panel constructed in accordance with a second embodiment of the invention.

FIG. 5 illustrates, in part, a method of constructing the sound absorbing panel of the present invention.

BEST MODE FOR CARRYING OUT THE INVENTION

To facilitate an understanding of the operation of the invention, it is desirable to first review the manner in which a conventional single-layer, laminar-type, sound absorbing panel operates.

If a fluid permeable, flow resistive facing sheet of acoustic resistance equal to $R/\rho c$ is placed in front of a honeycomb cell which is terminated at depth L by an impermeable backing sheet, then the acoustic impedance $Z/\rho c$ at the permeable facing sheet as seen by a sound wave carried by a medium and impinging on the facing sheet is:

$$Z/\rho c = R/\rho c + j(X/\rho c) = (R/\rho c) - j \cot KL$$

where

K is the wave number $K = 2\pi f/c$ f = frequency c = velocity of sound $\rho$ = density of the medium (gas)

As the frequency of the sound is increased, the cotangent term (reactance) cyclically passes from $-\infty$ to 0 to $+\infty$. At each zero value of the reactance, a resonance occurs and the sound absorption is large:

$$\alpha = \frac{4R'}{(R'+1)^2 + \underline{X}'^2} \qquad R' = \frac{R}{\rho o} \qquad \underline{X}' = \frac{\underline{X}}{\rho o}$$

and $\alpha$ is the sound absorption coefficient.

For large values of reactance, the absorption is small and vanishes at $X = \pm\infty$. Stated in another way, the air space behind the permeable flow resistive facing sheet becomes resonant at each frequency for which its depth L equals an odd multiple of one-quarter wavelength, and the absorption is large at these frequencies. However, at each frequency for which the air space depth L is an even number of quarter wavelengths, an anti-resonance occurs and at these frequencies no sound is absorbed.

Figure 1:
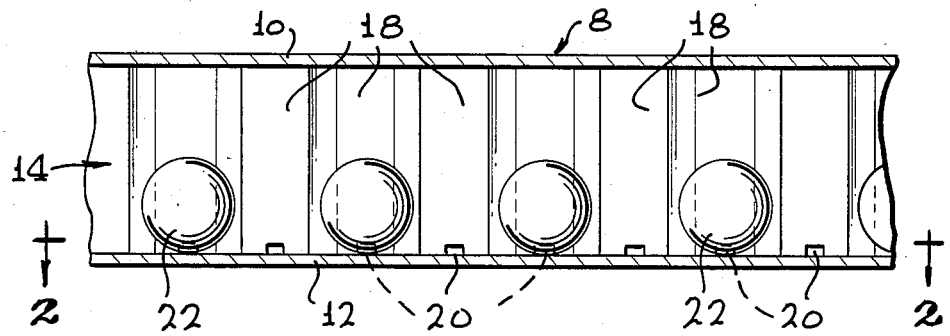
FIG. 1 is a side view of a sound absorbing panel constructed in accordance with a first embodiment of the invention.

Referring now to FIG. 1, there is shown a side view of a first embodiment of a sound absorbing panel constructed in accordance with the invention. The upper surface of the panel 8 comprises a permeable flow resistive facing sheet 10 which is relatively sound transparent. Facing sheet 10 may be fabricated from metal, plastic, ceramic or other suitable material and is supported by, and spaced apart from, impermeable backing sheet 12 by an interposed cellular structure preferably of the form of honeycomb core 14. The backing sheet 12 likewise may be fabricated from metal, plastic, etc. The honeycomb core 14 of the panel 8 is a standard commercial honeycomb core made up of hexagonal cells 18, and is typical of the honeycomb cores manufactured by Hexcel Standard Products, Long Beach, Calif. The honeycomb core 14 may also consist of square, pentagonal or other shapes of polygonal cells 18. In each of the cells 18 drainage is provided by small notches 20, typically an $\frac{1}{8}$ inch square milled into the surface 19 of the cell 18 of the core which is bonded to the backing sheet 12.

Figure 2:
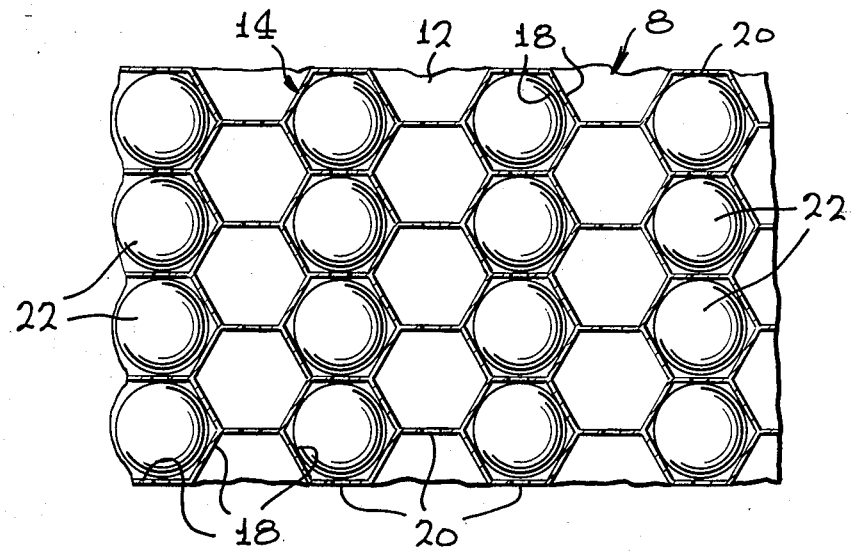
FIG. 2 is a plan view of a sound absorbing panel constructed in accordance with the first embodiment of the invention taken along the line 2—2 of FIG. 1.
Figure 4:
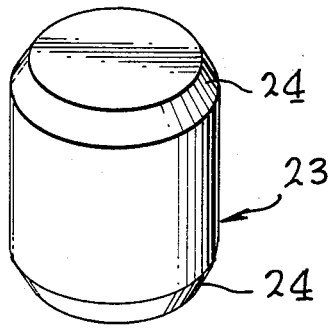
FIG. 4 is an isometric view of a cell filling object suitable for use with the aforementioned embodiments of the invention.

Approximately 50 percent of the cells may be filled with impermeable spheres 22. As shown in FIGS. 1 and 2, alternating rows of cells 18 contain impermeable spheres 22; however, the cells 18 may be randomly filled with only a slight degradation in sound absorption of the panel 8 as shown in FIG. 3. Besides spheres, other three dimensional closed surfaces 22 may be used, such as the cylinder 23 having chamfered ends 24 shown in FIG. 4. The chamfered ends 24 permit the cylinder 23 to be more easily placed in a cell 18 and to permit drainage around the chamfered ends 24. The impermeable sphere 22 may be constructed of any suitable material, such as metal, plastic, etc., and may be solid, or, to save weight, may be hollow or made of a closed pore foam as shown in FIGS. 1 and 2, the diameter of the sphere 22 may be equal to the width of the cell 18 so that the spheres 22 contacts the sides of cell 18 and does not float around in the cells 18. The diameter of the impermeable sphere 22 may also be smaller than the width of the cell 18 and the sphere 22 may be bonded, using an adhesive, to the sides of cell 18 at any position between facing sheet 10 and backing sheet 12 or to the impermeable backing sheet 12 itself.

As will be readily appreciated, the volume of a cell 18 having a sphere 22 therein is considerably less than the volume of an adjacent empty cell 18; hence, the impedances (and therefore the resonant frequencies) of adjacent cells 18 will be dissimilar. The position of the sphere 22 within the cell 18 may be adjusted to change the impedance and hence the resonant tuning of the cell 18.

Other variations in geometry may be made as long as the underlying concept is adhered to wherein adjacent cells 18 have three dimensional closed surfaces 22 therein to produce different resonant frequencies. In FIG. 3, for example, a honeycomb core 29 with square cells 30 is shown. Alternate rows 29A of cells 18 contain therewithin chamfered cylinders 23, of the type shown in FIG. 4, of different lengths while the rows 29B therebetween are empty. The chamfered cylinders 23 may contact the sides of the cells 30 but still allow drainage, for example, through notches 20 in the corners of the cells 30. The overall physical dimensions or partial filling of the cells 30 with closed surfaces 22 will, of course, be dictated by the operational requirements discussed above.

A method of placing the spheres 22 in the honeycomb core 14 is discussed with reference to FIG. 5. A tray 36 is formed from a sheet of corrugated material 40. The pitch 37 of the corrugations is equal to the center to center spacing 21 of the spheres 22 as installed in the honeycomb core 14 shown in FIGS. 1 and 2. The tray 36 is then elevated slightly at one end so that the spheres 22 placed in the "V" 39 of the corrugations will roll down to one end. Thus, the spheres 22 will align themselves in a parallel spaced arrangement. Next, a sheet 38 having a tacky surface 42 is laid across the tray 36. The spheres 22 will adhere to the tacky surface 42 of the sheet 38. The sheet 38 is next placed on the honeycomb core 14 and the spheres 22 are pressed into place into the cells 18 using, for example, a hand roller. After the sheet 38 is peeled away, the facing sheet 10 and backing sheet 12 may be affixed to the honeycomb core 14 by conventional methods of manufacture.

While the invention has been described with reference to the particular embodiments, it should be understood that the embodiments are merely illustrative as there are numerous variations and modifications which may be made by those skilled in the art. Thus, the invention is to be construed as being limited only by the spirit and scope of the appended claims.

I claim:

1. A sound absorbing panel comprising:

an array of wall defining means configured to provide two or more contiguous, hollow cells having adjacent open ends and adjacent impermeable ends, said open ends defining a sound receiving end of said array;

at least one impermeable three dimensional closed surface disposed in at least one of said cells; and, a flow resistive permeable facing sheet covering said sound receiving end.

2. The panel of claim 1 wherein approximately 50 percent of said cells contain said three dimensional closed surfaces.

3. The panel of claim 1 wherein said open ends are square.

4. The panel of claim 1 wherein said open ends are hexagonal.

5. The panel of claim 1 wherein said three dimensional closed surface is a sphere.

6. The panel of claim 1 wherein said three dimensional closed surface is a cylinder.

7. The panel of claim 1 wherein said three dimensional closed surface is bonded to said impermeable ends.

8. The panel of claim 1 wherein said three dimensional closed surface is bonded to said wall defining means.

9. The panel of claim 1 further comprising a drainage notch provided in each of said cells.

10. The panel of claim 1 wherein said three dimensional closed surfaces are hollow.

11. The panel of claim 1 wherein said three dimensional closed surfaces are solid.

12. The panel of claim 1 wherein said three dimensional closed surfaces are made of closed pore foam.

13. The panel of claim 2 wherein said three dimensional closed surfaces are disposed in said cells in a periodic arrangement.

14. The panel of claim 6 wherein said cylinder is chamfered.

* * * * *